US007768455B2

(12) United States Patent
Jung et al.

(10) Patent No.: US 7,768,455 B2
(45) Date of Patent: Aug. 3, 2010

(54) ANTENNA FOR CONTROLLING RADIATION DIRECTION

(75) Inventors: Chang-won Jung, Hwaseong-si (KR); Young-eil Kim, Suwon-si (KR); Jennifer T Bernhard, Champaign, IL (US); Jessica Ruyle, Urbana, IL (US)

(73) Assignee: Samsung Electronics Co., Ltd., Suwon-si (KR)

( * ) Notice: Subject to any disclaimer, the term of this patent is extended or adjusted under 35 U.S.C. 154(b) by 254 days.

(21) Appl. No.: 11/972,144

(22) Filed: Jan. 10, 2008

(65) Prior Publication Data

US 2009/0179819 A1 Jul. 16, 2009

(51) Int. Cl.
*H01Q 1/38* (2006.01)

(52) U.S. Cl. ..... 343/700 MS; 343/876

(58) Field of Classification Search ..... 343/700 MS, 343/745, 846, 876
See application file for complete search history.

(56) References Cited

U.S. PATENT DOCUMENTS

| | | | | |
|---|---|---|---|---|
| 5,777,581 | A * | 7/1998 | Lilly et al. | 343/700 MS |
| 6,061,025 | A * | 5/2000 | Jackson et al. | 343/700 MS |
| 6,501,427 | B1 * | 12/2002 | Lilly et al. | 343/700 MS |
| 2009/0058731 | A1 * | 3/2009 | Geary et al. | 343/700 MS |

* cited by examiner

*Primary Examiner*—Hoang V Nguyen
(74) *Attorney, Agent, or Firm*—Sughrue Mion, PLLC

(57) ABSTRACT

An antenna for controlling a radiation pattern includes a first substrate; a first radiator formed in one surface of the first substrate; a second radiator formed in other surface of the first substrate; and a tuning part which controls a radiation pattern by changing a size of an overlapping region of the first radiator and the second radiator disposed with the first substrate interposed therebetween according to an external control signal. The tuning part includes a plurality of sub-radiators arranged by at least one side of the first radiator or the second radiator, and a plurality of switches. Accordingly, the beam radiation pattern can be easily controlled through the switch control.

12 Claims, 12 Drawing Sheets

ANTENNA FOR CONTROLLING RADIATION DIRECTION

BACKGROUND OF THE INVENTION

1. Field of the Invention

Apparatuses and methods consistent with the present invention relate to an antenna. More particularly, the present invention relates to an antenna and a method for controlling its radiation direction by adjusting counter regions of radiators.

2. Description of the Related Art

Antennas convert electrical signals into electromagnetic waves and radiate them into a free space, and vice versa. In general, an effective region where the antenna can radiate or detect the electromagnetic waves is called a radiation pattern, and a direction of the radiation pattern is called a radiation direction.

In the mean time, antennas aimed at short range communications or military purposes can be implemented to have a sharp radiation pattern to increase antenna reception efficiency. To this end, a plurality of antennas is arranged in a specific structure to match the radiation pattern and the radiation power of the antennas. As a result, the overall radiation pattern can be sharpened and the electromagnetic waves of the antennas can be radiated much further. Such an antenna structure is called an array antenna. The array antenna can attain the sharp radiation pattern.

When the radiation pattern is sharp, it is difficult to receive omni-directional signals. Thus, as for the sharp radiation pattern, it is preferred to receive signals in various directions by adjusting the radiation direction.

The array antenna can steer the direction of the radiated beam by regulating a phase of the signals transmitted on the antennas. However, since the array antenna utilizes the multiple antennas, its size is quite large.

Therefore, what is needed is a method for adjusting the radiation direction in various directions without employing the array antenna.

SUMMARY OF THE INVENTION

Exemplary embodiments of the present invention may overcome the above disadvantages and other disadvantages not described above. Also, the present invention is not required to overcome the disadvantages described above, and an exemplary embodiment of the present invention may not overcome any of the problems described above.

The present invention provides an antenna for easily controlling a beam radiation direction by adjusting an area of the counter regions of radiators.

According to an aspect of the present invention, there is provided an antenna including a first substrate; a first radiator formed in one surface of the first substrate; a second radiator formed in other surface of the first substrate; and a tuning part which controls a radiation pattern by changing a size of an overlapping region of the first radiator and the second radiator disposed with the first substrate interposed therebetween according to an external control signal.

The tuning part may include a plurality of sub-radiators arranged by at least one side of the first radiator over one surface of the first substrate; and a plurality of switches which adjust the area of the first radiator by connecting or disconnecting the sub-radiators and connecting or disconnecting one of the sub-radiators to and from the first radiator according to the external control signal.

The sub-radiators may be sequentially arranged by at least one side of the first radiator, and each of the sub-radiators may be formed in a bar shape.

An area of the second radiator may be greater than an area of the first radiator, and the sub-radiators may be arranged in a region where the first radiator is not formed within a counter region of the second radiator over one surface of the first substrate.

The switches may be PIN diodes.

The antenna may further include a second substrate contacting the first substrate in a direction by which the second radiator is formed; a ground layer formed in a counter surface of the surface contacting the first substrate among surfaces of the second substrate; and a feed line penetrating the second substrate and connected to the second radiator. The first and second radiators may be formed as a patch in either surface of the first substrate.

The tuning part may include a plurality of sub-radiators arranged by at least one side of the second radiator in the other surface of the first substrate; and a plurality of switches which adjust an area of the second radiator by connecting or disconnecting at least one of the sub-radiators to and from the second radiator and connecting or disconnecting the sub-radiators.

The sub-radiators may be sequentially arranged by at least one side of the second radiator, and the sub-radiators may be formed as a bar shape.

An area of the first radiator may be greater than the area of the second radiator, and the sub-radiators may be arranged in a region where the second radiator is not formed within a counter region of the first radiator over the other surface of the first substrate.

The switches may be PIN diodes.

The antenna may further include a connector which connects to a coaxial cable, the connector being disposed in one surface of the second substrate where the ground layer is formed.

The first radiator, the second radiator, and the tuning part may be formed in plural numbers.

The antenna may further include a controller which provides the external control signal with respect to each of the switches.

In another exemplary embodiment of the invention, there is a method of controlling a radiation pattern of an antenna, the method including: receiving a control signal; and controlling a radiation pattern emitted by the antenna in response to the control signal, the controlling comprising, changing an amount of overlap between a first radiator and a second radiator, the first radiator being disposed at one surface of a first substrate and the second radiator being formed at another surface of the substrate.

BRIEF DESCRIPTION OF THE DRAWING FIGURES

The above and/or other aspects of the present invention will be more apparent by describing certain exemplary embodiments of the present invention with reference to the accompanying drawings, in which.

DETAILED DESCRIPTION OF THE EXEMPLARY EMBODIMENTS

Figure 1:
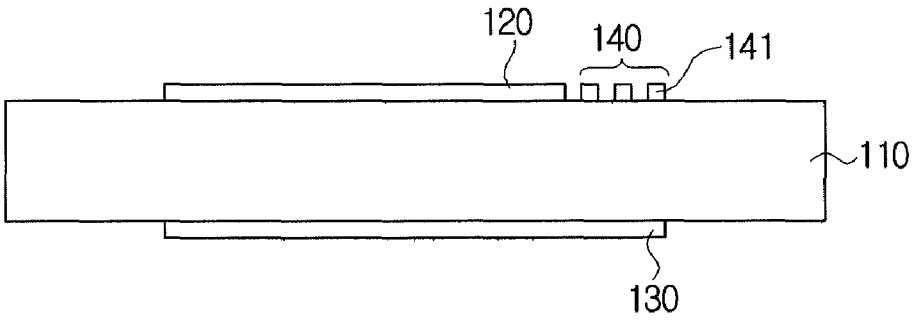
FIG. 1 is a schematic diagram of an antenna according to an exemplary embodiment of the present invention.

Certain exemplary embodiments of the present invention will now be described in greater detail with reference to the accompanying drawings.

In the following description, the same drawing reference numerals are used to refer to the same elements, even in different drawings. The matters defined in the following description, such as detailed construction and element descriptions, are provided as examples to assist in a comprehensive understanding of the invention. Also, well-known functions or constructions are not described in detail, since they would obscure the invention in unnecessary detail.

FIG. 1 is a vertical sectional view of an antenna according to an exemplary embodiment of the present invention. The antenna comprises a first substrate 110, a first radiator 120, a second radiator 130, and a tuning part 140.

The first substrate 110 can be implemented using a printed circuit board (PCB). The first radiator 120 and the second radiator 130 can be formed as a patch in either surface of the first substrate 110.

When an electric signal is applied from outside, the second radiator 130 is coupled with the first radiator 120 to convert the electrical energy to electromagnetic waves and radiate them into the air.

The first radiator 120 and the second radiator 130 are disposed to face each other based on the first substrate 110; that is, formed in the counter regions or opposite regions of the first substrate. According to the difference of the areas of the first radiator 120 and the second radiator 130, there exists an overlapping region and a non-overlapping region. When the first radiator 120 and the second radiator 130 are formed exactly in the counter positions and there is no non-overlapping region, electronic field perpendicular in the lower direction is generated and accordingly the beam radiation direction proceeds forward. By contrast, when there exists a non-overlapping region, the electronic field is deformed at the edges and the beam radiation direction is also distorted. That is, the beam radiation direction depends on the position and the size of the first radiator 120 and the second radiator 130.

The tuning part 140 controls the beam radiation direction by changing the size of overlapping area between the first radiator 120 and the second radiator 130 according to an external control signal.

Specifically, the tuning part 140 can effectively increase or decrease the area of the first radiator 120 or the second radiator 130. FIG. 1 depicts the increase or the decrease of the area of the first radiator 120, which is now described.

In FIG. 1, the tuning part 140 includes a plurality of sub-radiators 141. The sub-radiators 141 are formed in a bar shape and sequentially arranged by one side of the first radiator 120 over the surface of the first substrate 110. The second radiator 130 in FIG. 1 is formed in a greater size than the first radiator 120 in the counter surface of the first radiator 120. Accordingly, a non-overlapping region is formed between the second radiator 130 and the first radiator 120. The sub-radiators 141 are disposed in the non-overlapping region. Switches (not shown) are disposed between the sub-radiators 141 and between the last sub-radiator 141 and the first radiator 120. By controlling ON/OFF of the switches, the tuning part 140 controls the connection between the first radiator 120 and the sub-radiators 141. As the sub-radiator 141 is connected, the size of the overlapping region between the first radiator 120 and the second radiator 130 increases. Thus, the electronic field pattern between the first radiator 120 and the second radiator 130 also changes. Consequently, the beam radiation direction of the antenna is altered.

Figure 2:
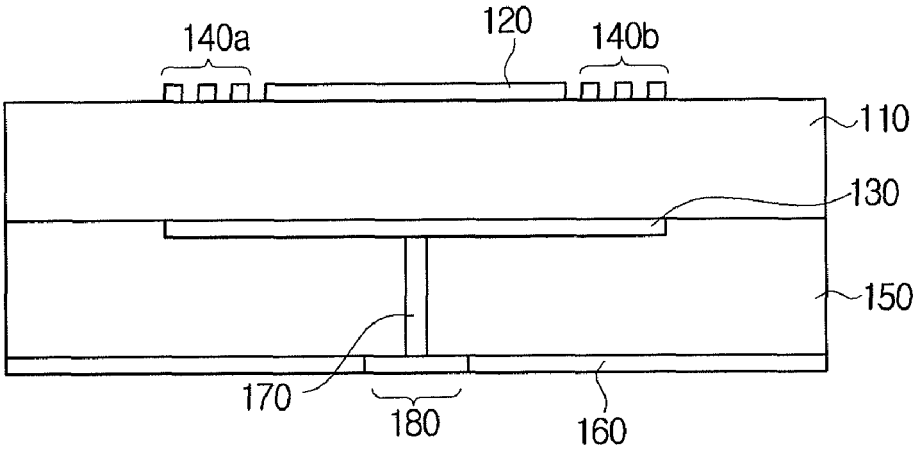
FIG. 2 is a schematic diagram of an antenna according to another exemplary embodiment of the present invention.

FIG. 2 is a vertical sectional view of an antenna according to another exemplary embodiment of the present invention. The antenna of FIG. 2 can further include a second substrate 150. The second substrate 150 contacts with the first substrate 110 from the side of the first substrate 110 where the second radiator 130 is formed. The second substrate 150 may be a PCB.

A ground layer 160 can be formed at the bottom of the second substrate 150. A feed line 170 penetrating the second substrate 150 can be formed to provide the electrical signal to the second radiator 130. In this case, the feed line 170 can be connected to a coaxial cable in the below the second substrate 150. To do so, a connector 180 can be disposed in the ground layer 160 to connect to the coaxial cable. The coaxial cable connected through the connector 180 supplies the electrical energy to the ground layer 160 and the feed line 170.

Tuning parts 140*a* and 140*b* can be formed on either side of the first radiator 120 over the surface of the first substrate 110. Thus, the beam radiation pattern can be regulated according to the connections between sub-radiators of the tuning parts 140*a* and 140*b* and the first radiator 120.

Figure 3:
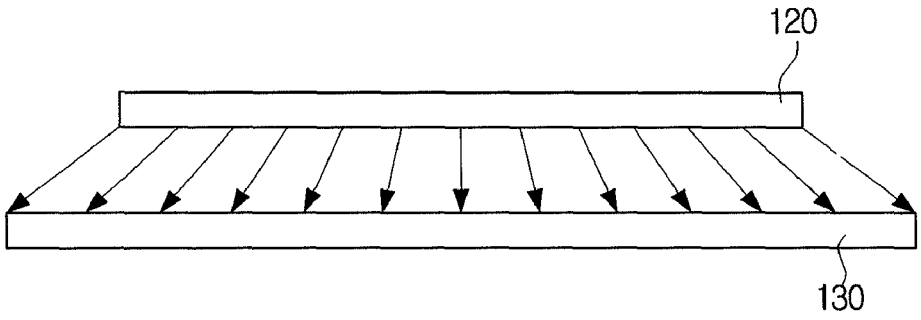
FIG. 3 is a schematic diagram of an electronic field pattern between radiators.

FIG. 3 is a schematic diagram of an electronic field pattern between the first radiator 120 and the second radiator 130. As shown in FIG. 3, the area difference, i.e., the difference in overlap, of the first radiator 120 and the second radiator 130 causes the variation of the electronic field direction at the edges of the first radiator 120. In this situation, when the first radiator 120 and the second radiator 130 are matched in exactly the same form, the electronic field perpendicular in the lower side can be generated to be similar to the electronic field at the center.

Figure 4:
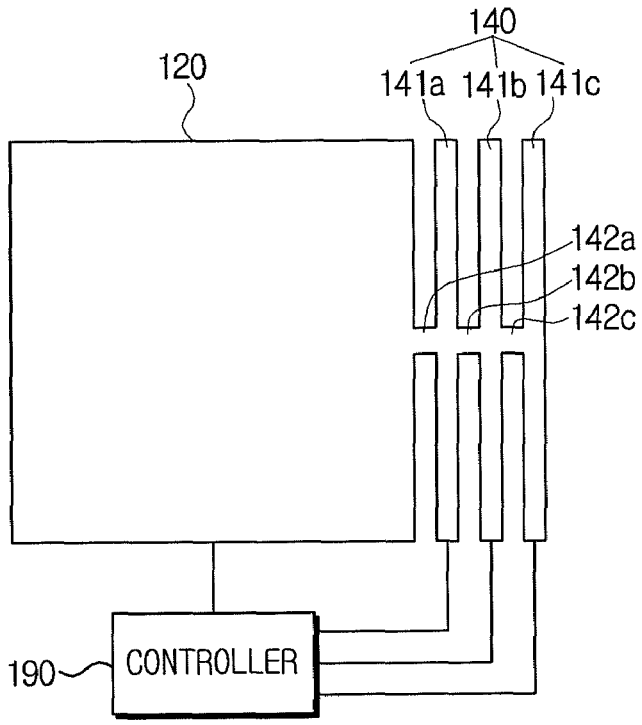
FIG. 4 is a detailed diagram of the antenna.

FIG. 4 is a detailed diagram of the tuning part 140. Particularly, FIG. 4 is a plane view of the antenna, which is taken from above. A plurality of sub-radiators 141*a*, 141*b* and 141*c* are arranged in order by one side of the first radiator 120 as shown in FIG. 4. Switches 142*a*, 142*b* and 142*c* are connected to the sub-radiators 141*a*, 141*b* and 141*c* respectively. The switches 142*a*, 142*b* and 142*c* can be embodied as PIN diode switches, general diode switches, and other MEMS switches.

The antenna can further include a controller 190 to control the ON/OFF states of the switches 142*a*, 142*b* and 142*c*. The controller 190 can be integrated with the substrate 110. The controller 190 is electrically connected to the first radiator 120 and the sub-radiators 141*a*, 141*b* and 141*c* to provide a control signal so as to change the effective area of the first radiator 120. The control signal can be implemented as a pulse having high and low values.

When the switch is implemented using a PIN diode, the controller 190 can turn on the corresponding switch by applying a voltage greater than 0.7V, about 1V, between P-N. Conversely, the controller 190 may turn off the corresponding switch by applying the voltage less than 0.7V (threshold voltage).

The turn-on and turn-off of the switches 142*a*, 142*b* and 142*c* and the change of the radiation direction are explained by referring to FIGS. 5A through 11B. FIGS. 5A, 6A, 7A, 8A, 9A, 10A, and 11A are plane views for explaining the changes of the area of the first radiator 120 according to the turn-on and turn-off of the switches. FIGS. 5B, 6B, 7B, 8B, 9B, 10B, and 11B depict the changes of the radiation direction according to the changes of the area of the first radiator 120.

Figure 5A:
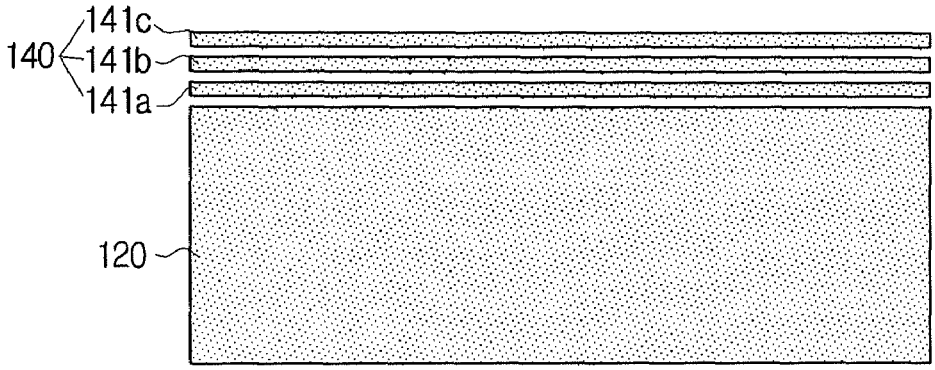
FIGS. 5A, 5B, 6A, 6B, 7A, 7B, 8A, 8B, 9A, 9B, 10A, 10B, 11A and 11B are schematic diagrams of a radiation pattern regulated according to changes in an external control signal according to an exemplary embodiment of the present invention.
Figure 5B:
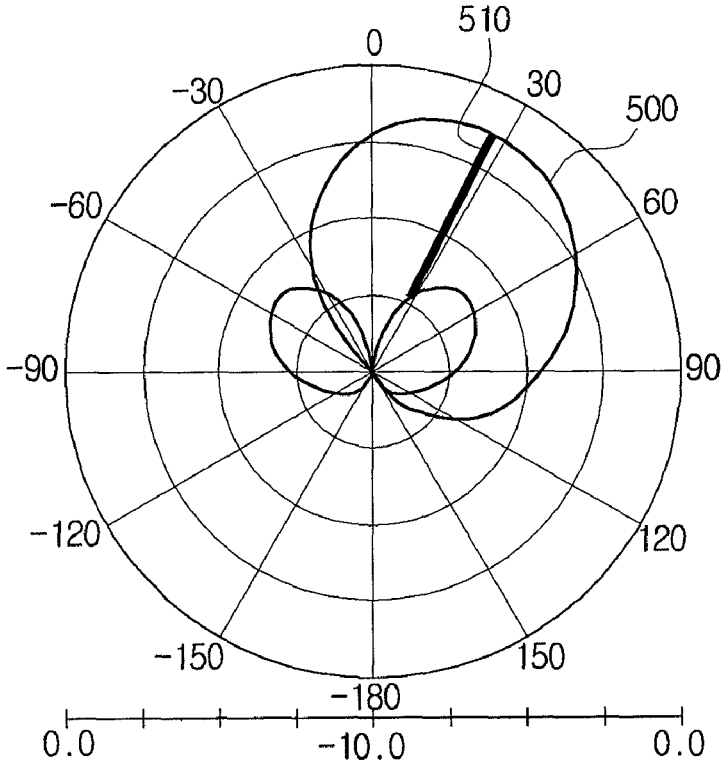

FIGS. 5A and 5B depict the radiation pattern when every switch 142*a*, 142*b* and 142*c* is turned off in the antenna of FIG. 2. When the switches 142*a*, 142*b* and 142*c* are turned off as shown in FIG. 5A, the first radiator 120 and the sub-radiators 141*a*, 141*b* and 141*c* are disconnected. Hence, the electronic field direction is deformed at the edges of the first radiator 120 as shown in FIG. 3. As a result, the radiation pattern 500 is tilted to the north, that is, to the right from 0 degree as shown in FIG. 5B. In specific, the radiation direction axis 510 inclines by 26 degrees or so.

Figure 6A:
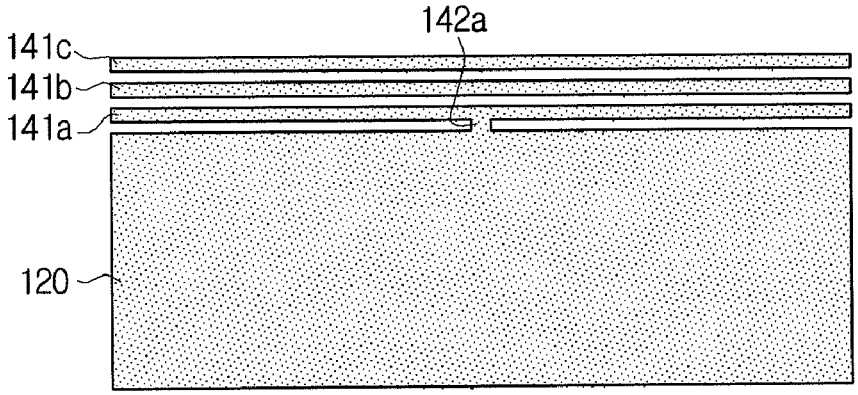
Figure 6B:
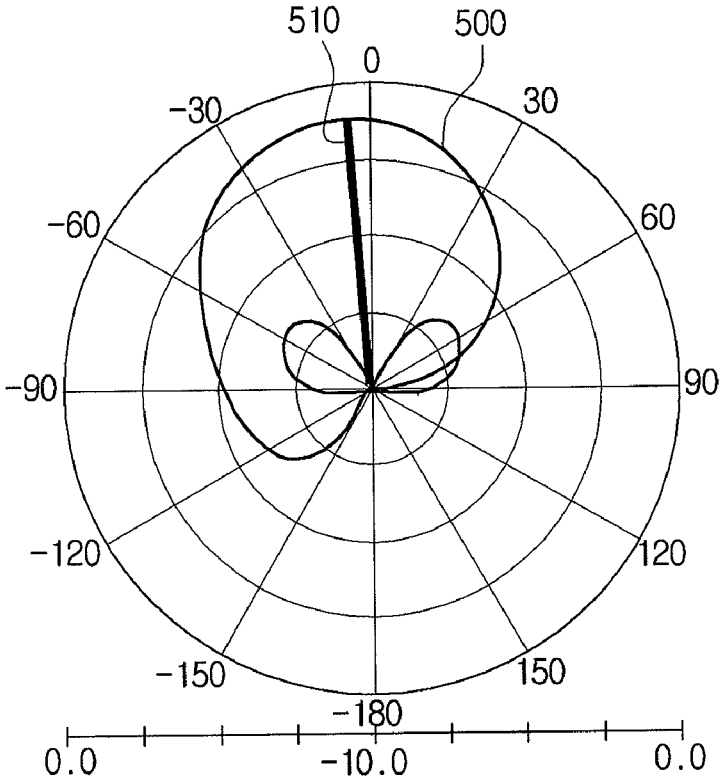

In this state, when the first switch 142*a* is turned on, the first sub-radiator 141*a* is connected to the first radiator 120 as shown in FIG. 6A. Accordingly, the area of the first radiator 120 increases and the distance difference between the edge of the second radiator 130 and the edge of the first radiator 120 at the bottom decreases. Consequently, the radiation direction axis is changed to −4 degrees or so as shown in FIG. 6B.

Figure 7A:
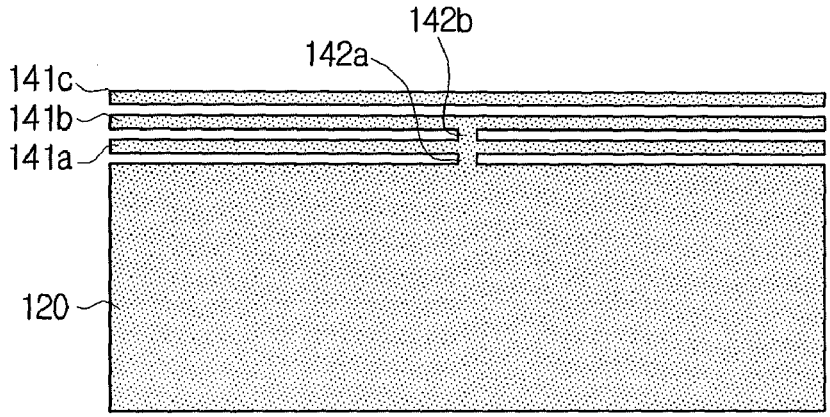
Figure 7B:
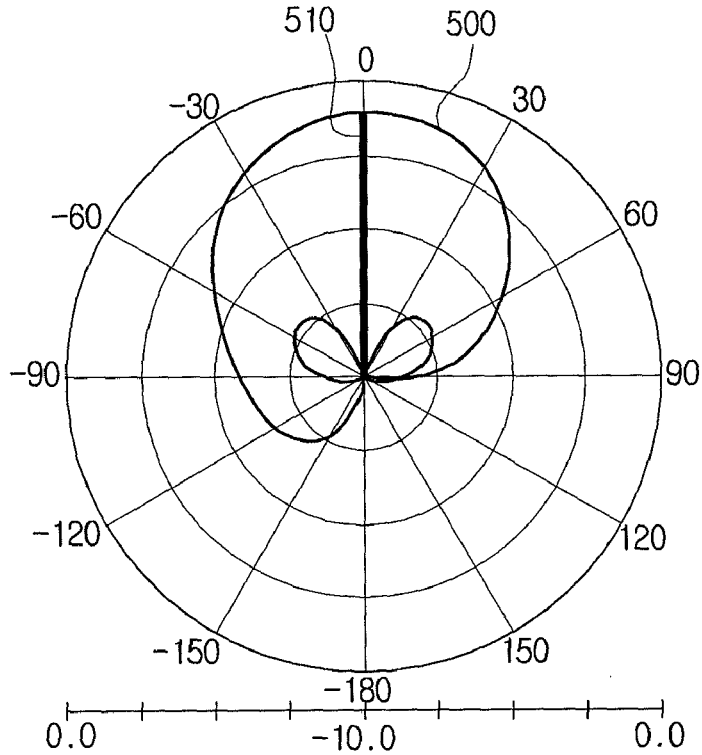

FIG. 7A depicts the turn-on of the first and second switches 142*a* and 142*b*. Since the first and second sub-radiators 141*a* and 141*b* are connected to the first radiator 120, the area of the first radiator 120 increases. Thus, the radiation direction 500 is changed such that the radiation direction axis 510 directs 0 degree as shown in FIG. 7B.

Figure 8A:
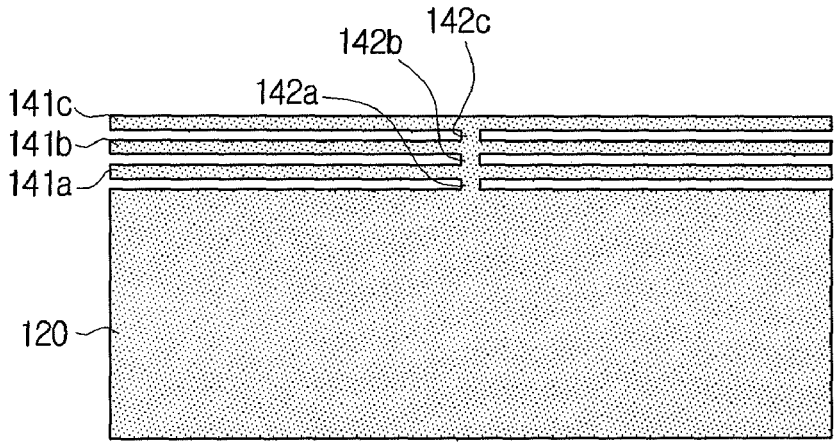
Figure 8B:
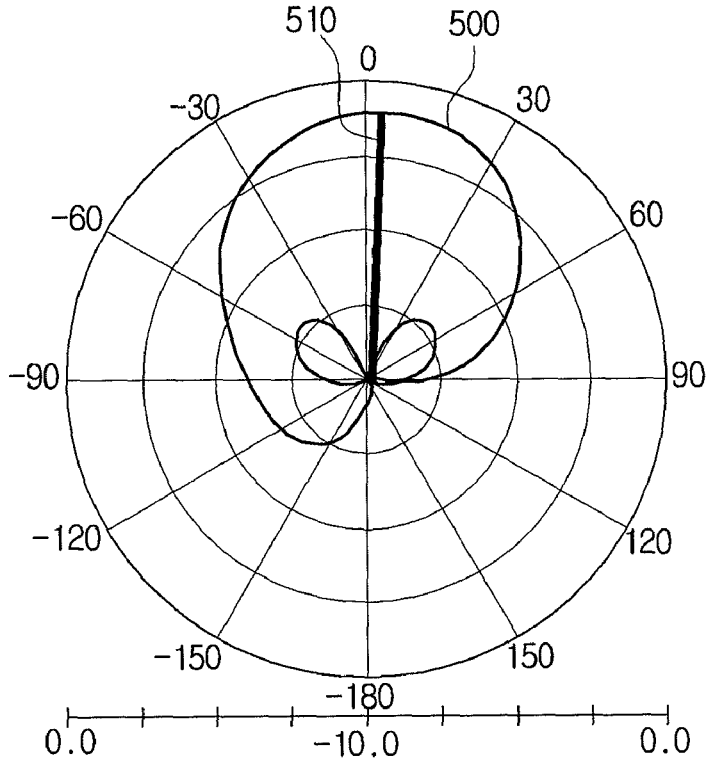

FIG. 8A depicts the turn-on of the first, second and third switches 142*a*, 142*b* and 142*c*. All of the sub-radiators 141*a*, 141*b* and 141*c* are connected to the first radiator 120, and the radiation direction axis 510 is changed by about 2 degrees as shown in FIG. 8B.

Figure 9A:
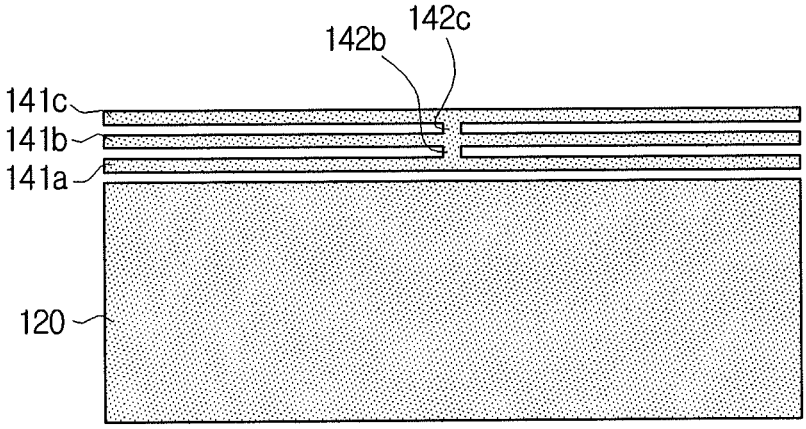
Figure 9B:
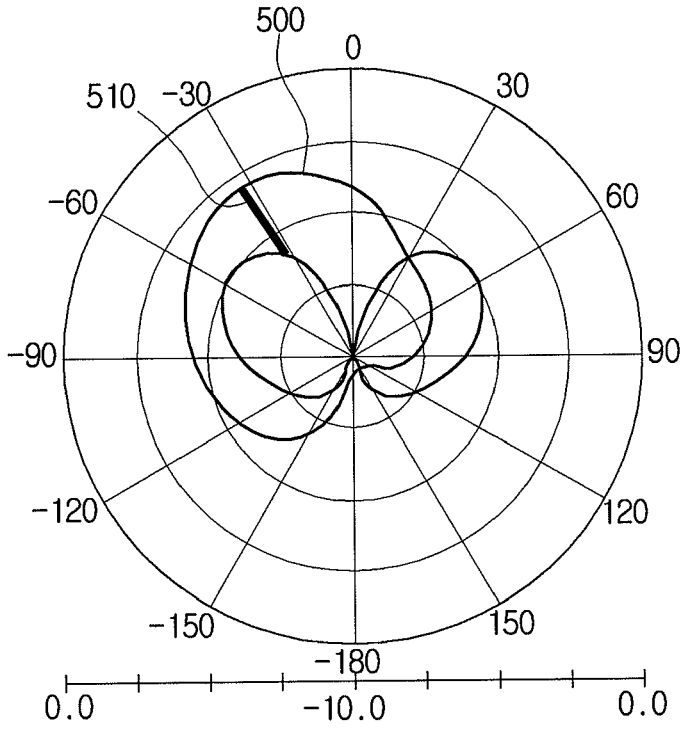

FIG. 9A depicts the turn-off of the first switch 142*a* and the turn-on of the second and third switches 142*b* and 142*c*. The area of the first radiator 120 is not increased at all. One sub-radiator 141*a*, 141*b* or 141*c* formed by the side of the first radiator 120 produces another electronic field with respect to the second radiator 130 at the bottom. Accordingly, the radiation direction axis is inclined at −32 degrees as shown in FIG. 9B.

Figure 10A:
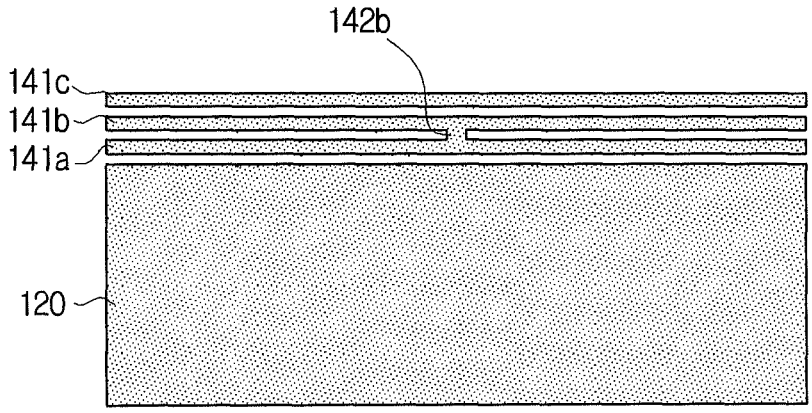
Figure 10B:
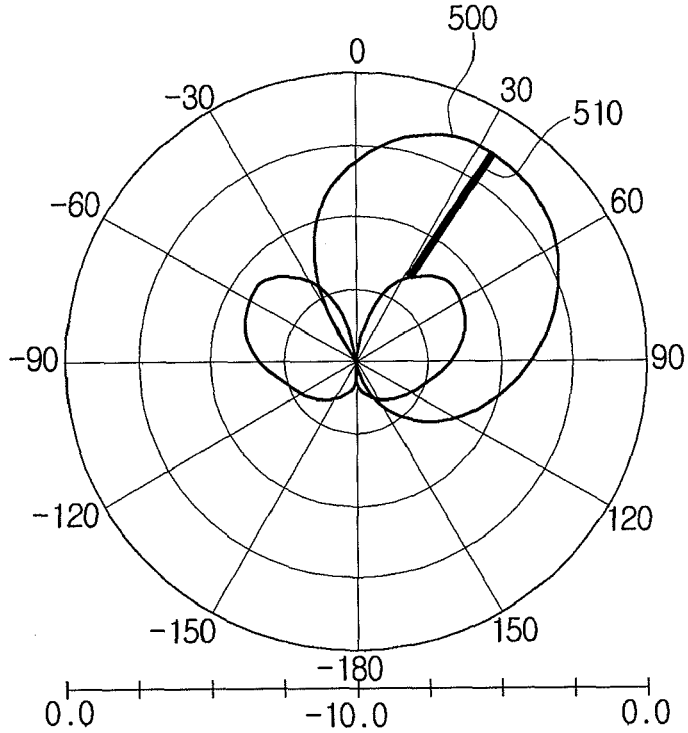
Figure 11A:
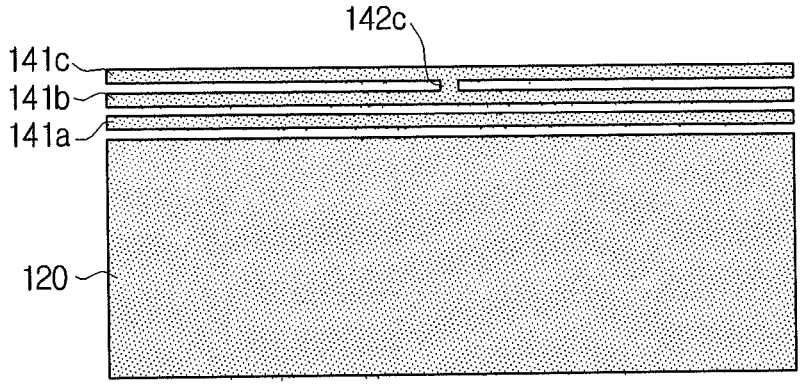
Figure 11B:
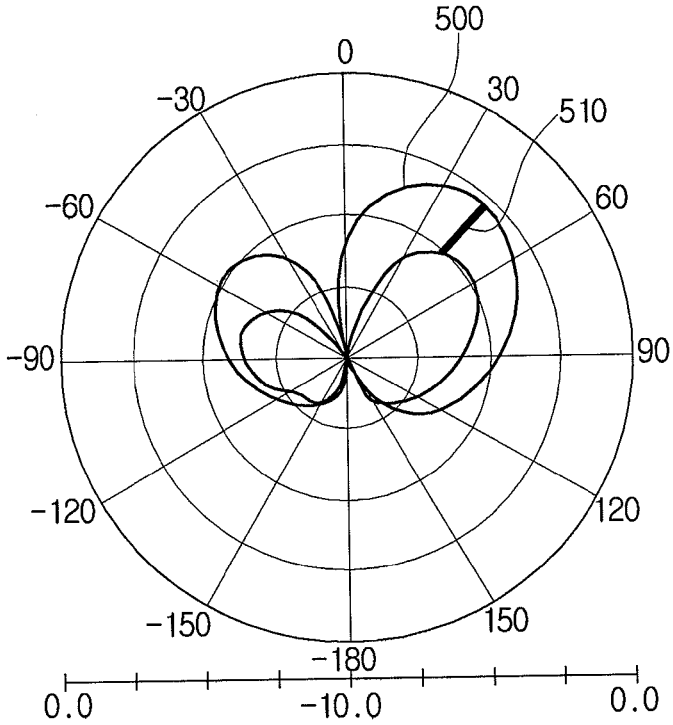

When only the second switch 142*b* is turned on in FIG. 10A, the radiation direction axis at about 32 degrees is generated as shown in FIG. 10B. When only the third switch 142*c* is turned on in FIG. 11A, the radiation direction axis is inclined at 42 degrees or so as shown in FIG. 11B.

As above, by controlling the turn-on and the turn-off by combining the switches 142*a*, 142*b* and 142*c*, the area difference, i.e., the difference in overlap, between the first radiator 120 and the second radiator 130 can be regulated. Therefore, the radiation direction can be variously controlled as shown in FIGS. 5B, 6B, 7B, 8B, 9B, 10B and 11B.

Figure 12:
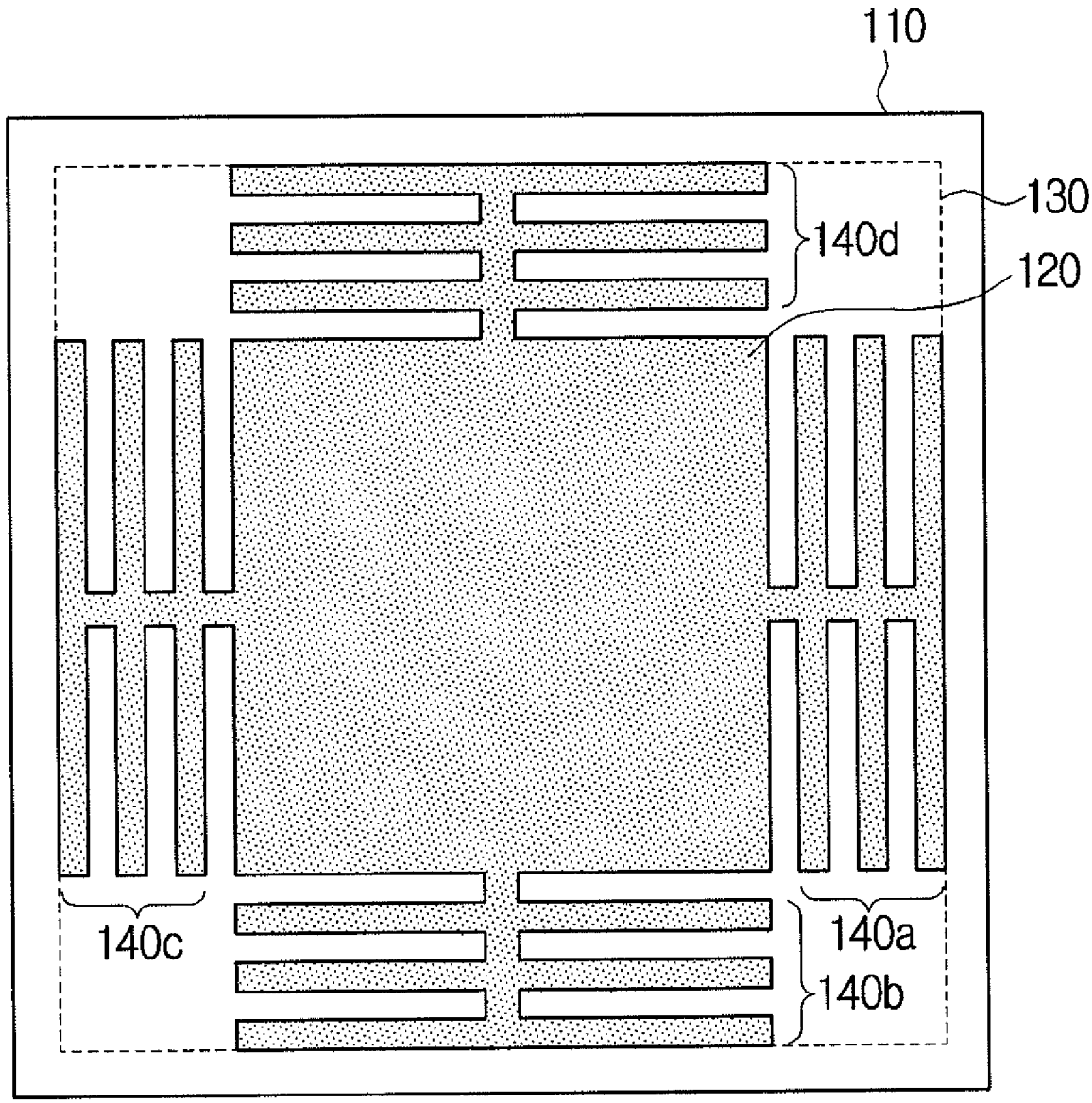
FIGS. 12 through 15 are schematic diagrams of an antenna according to various embodiments of the present invention.

FIGS. 12 through 15 are schematic diagrams of an antenna according to various embodiments of the present invention. Referring first to FIG. 12, the first radiator 120 is formed as a square. The tuning parts 140*a*, 140*b*, 140*c* and 140*d* are formed at each side of the square. While each tuning part 140*a*, 140*b*, 140*c* and 140*d* includes three sub-radiators, the number of the sub-radiators is variable. The shape of the sub-radiator can be implemented in other shapes than the bar.

The tuning parts 140*a*, 140*b*, 140*c* and 140*d* are formed in the regions where the second radiator 130 at the bottom is formed, over the surface of the first substrate 110. Since the area of the first radiator 120 is smaller than that of the second radiator 130, the tuning parts 140*a*, 140*b*, 140*c* and 140*d* can be formed in the non-overlapping region. A plurality of switches can be formed between the sub-radiators. In FIG. 12, every switch is turned on and accordingly, all of the sub-radiators are connected to the first radiator 120.

While one switch is formed in a certain region of one of the sub-radiators, the shape, the position, and the number of the switch may vary.

Figure 13:
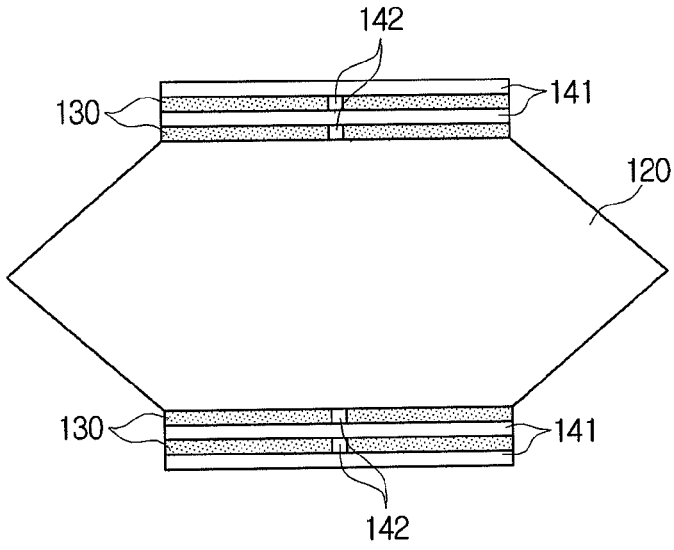

FIG. 13 depicts an antenna including the first radiator 120 formed as a hexagon. The sub-radiators 141 can be formed in two sides facing each other among the sides of the first radiator 120, and the switches 142 can be formed therein. Similar to the above embodiments of the present invention, the second radiator 130 is disposed at the bottom of the first radiator 120 and the sub-radiators 141.

Figure 14:
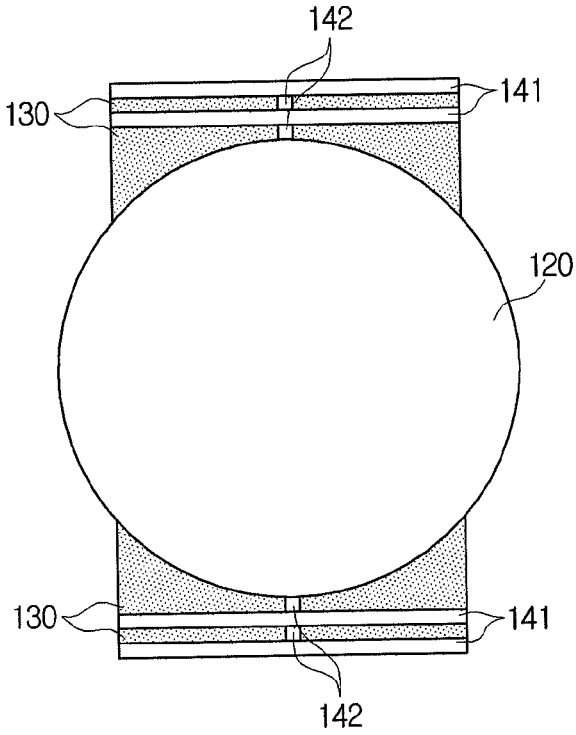

The first radiator 120 can be formed in a circular shape as shown in FIG. 14. In this case, the sub-radiators 141 can be formed in either side facing each other based on the first radiator 120. The radiation direction of the antennas of FIGS. 13 and 14 can be controlled by changing the area of the first radiator 120 according to the operation of the switches 142 between the sub-radiators 141.

Figure 15:
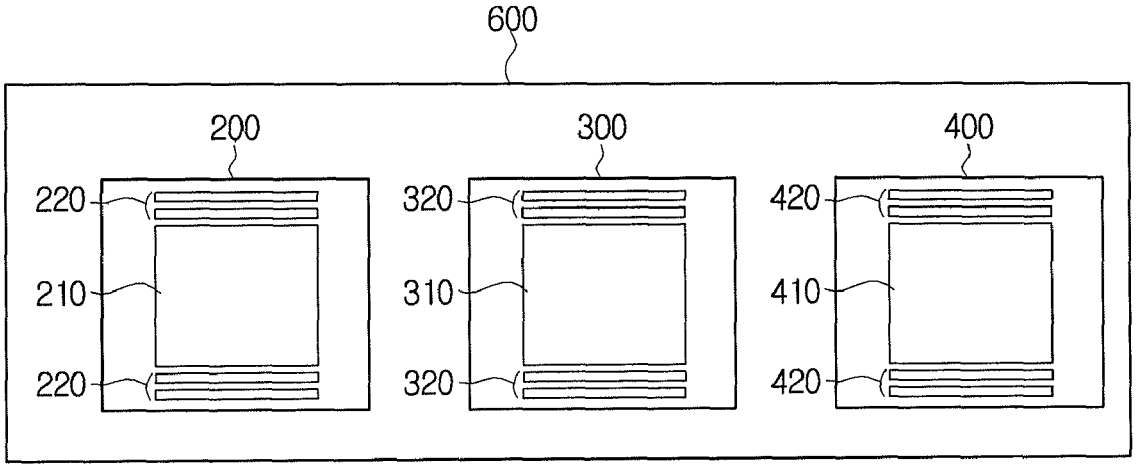

FIG. 15 depicts an antenna implemented as a multiple input multiple output (MIMO) system. The MIMO system performs the MIMO operation by combining a plurality of antennas. Herein, the antennas can adopt the antenna constitutions as discussed above. That is, the MIMO antenna system 600 includes a plurality of antennas 200, 300 and 400.

Each antenna 200, 300 and 400 includes a first radiator 210, 310 and 410. A plurality of tuning parts 220, 320, and 420 is formed by one side of the first radiator 210, 310 and 410. The radiation direction can be variously changed by controlling the area difference between the first radiators 210, 310 and 410 and the second radiator at the bottom as described in FIGS. 5A through 11A.

While the tuning part 140 is formed in the same surface as the first radiator, the tuning part 140 can be formed in the same surface as the second radiator. In this case, the areas of the first radiator 120 and the second radiator 130 set to the same size, and at least one sub-radiator and switch are formed by one side of the second radiator 130. Therefore, every time the switch is turned on, the area of the second radiator 130 can increase. Since the shape and the operation of the sub-radiators and the switches have been illustrated above, their further description shall be omitted.

In alternative embodiments, the present invention discloses methods for forming a radiation pattern formed according to the various antenna embodiments described above.

The antenna and methods for forming a radiation pattern according to the various embodiments of the present invention are applicable to handheld devices such as mobile phones and PDAs. By periodically changing the turn-on state and turn-off state of the switches, the omni-directional signals can be periodically scanned. To this end, it is preferred, in an exemplary embodiment, to design the antenna to produce the radiation pattern with various gains in various directions by examining and storing the radiation directions case by case through experiments which varies the shape of the sub-radiators and the combination of the switches. The controller 190 issues the control signal according to the stored switch combination to control ON/OFF states of the switches, to thus steer the beam radiation direction.

As set forth above, even using the single antenna, the beam radiation direction can be easily controlled by adjusting the size of the overlapping region of the radiators. Therefore, the antenna can be miniaturized while increasing the gain and receiving the signals from various directions.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. An antenna comprising:

a first substrate;

a first radiator formed at one surface of the first substrate;

a second radiator formed at another surface of the first substrate; and a tuning part which controls a radiation pattern by changing a size of an overlapping region of the first radiator and the second radiator disposed with the first substrate interposed therebetween, according to a control signal;

a second substrate which contacts the first substrate in a direction by which the second radiator is formed;

a ground layer formed in a surface of the second substrate; and a feed line penetrating the second substrate and connected to the second radiator, wherein each of the first and the second radiators are formed as a patch in the one and the other surfaces of the first substrate.

2. The antenna of claim 1, wherein the tuning part comprises:

a plurality of sub-radiators arranged at least one side of the first radiator and over the one surface of the first substrate; and a plurality of switches which adjust a total area of the first radiator by connecting or disconnecting one of the plurality of sub-radiators to and from the first radiator, and connecting or disconnecting other sub-radiators of the plurality of sub-radiators according to the control signal.

3. The antenna of claim 2, wherein the plurality of sub-radiators are sequentially arranged at the at least one side of the first radiator, and each of the plurality of sub-radiators is formed in a bar shape.

4. The antenna of claim 2, wherein an area of the second radiator is greater than an area of the first radiator, and the plurality of sub-radiators are arranged in a region where the first radiator is not formed, within a counter region of the second radiator over the one surface of the first substrate.

5. The antenna of claim 2, wherein the plurality of switches are PIN diodes.

6. The antenna of claim 2, further comprising:

a controller which provides the control signal with respect to each of the plurality of switches.

7. The antenna of claim 1, wherein the tuning part comprises:

a plurality of sub-radiators arranged at least one side of the second radiator in the other surface of the first substrate; and a plurality of switches which control connections between the plurality of sub-radiators to adjust a total area of the second radiator by connecting or disconnecting at least one of the plurality of sub-radiators to and from the second radiator and connecting or disconnecting other sub-radiators of the plurality of sub-radiators.

8. The antenna of claim 7, wherein the plurality of sub-radiators are sequentially arranged at least one side of the second radiator, and the plurality of sub-radiators are formed in a bar shape.

9. The antenna of claim 7, wherein an area of the first radiator is greater than the area of the second radiator, and the plurality of sub-radiators are arranged in a region where the second radiator is not formed within a counter region of the first radiator, over the other surface of the first substrate.

10. The antenna of claim 7, wherein the plurality of switches are PIN diodes.

11. The antenna of claim 1, further comprising:

a connector which connects to a coaxial cable, the connector being disposed in one surface of the second substrate where the ground layer is formed.

12. The antenna of claim 1, wherein each of the first radiator, the second radiator, and the tuning part are formed in plural numbers.

* * * * *